US007806263B1

(12) United States Patent
Carter

(10) Patent No.: US 7,806,263 B1
(45) Date of Patent: Oct. 5, 2010

(54) REMOVABLE CONTAINER ACCESSORY FOR A PORTABLE DEVICE

(76) Inventor: Twila Carter, 1374 W. Old Bittersweet, Nixa, MO (US) 65714

( * ) Notice: Subject to any disclaimer, the term of this patent is extended or adjusted under 35 U.S.C. 154(b) by 0 days.

(21) Appl. No.: 12/284,515

(22) Filed: Sep. 23, 2008

(51) Int. Cl.
*B65D 85/28* (2006.01)

(52) U.S. Cl. ..... 206/371; 206/214; 206/224; 281/30; 281/31

(58) Field of Classification Search ..... 206/371, 206/214, 224, 477, 478, 482, 483, 817, 320; 224/230, 269; 24/3.7, 3.12, 15; 281/30, 281/31
See application file for complete search history.

(56) References Cited

U.S. PATENT DOCUMENTS 1,610,535 A * 12/1926 Smith ..... 24/10 A
1,842,072 A * 1/1932 Collingbourne ..... 206/478
3,084,407 A * 4/1963 Settles ..... 24/3.7
3,147,896 A * 9/1964 Kehl ..... 224/240
3,627,182 A * 12/1971 Calkins ..... 224/584
3,885,667 A * 5/1975 Spiegel et al. ..... 206/478
4,174,798 A * 11/1979 Pollard ..... 224/674
4,587,151 A * 5/1986 Balland ..... 428/156
4,650,074 A * 3/1987 Vosbikian ..... 206/477
4,705,086 A * 11/1987 O'Neill ..... 150/134
4,784,199 A * 11/1988 Wise ..... 150/134
4,793,632 A * 12/1988 Hoffman, Jr. ..... 281/42
4,955,518 A * 9/1990 Parsons et al. ..... 224/247
5,000,327 A * 3/1991 Kincheloe ..... 211/88.01
5,103,884 A * 4/1992 Roman ..... 150/134
5,353,956 A * 10/1994 Wilson ..... 221/198
5,388,741 A * 2/1995 Hillinger ..... 224/679
5,718,023 A * 2/1998 Billish ..... 24/11 HC
6,409,016 B1 * 6/2002 Braginsky et al. ..... 206/397
6,626,336 B1 * 9/2003 Krusell ..... 224/271
2006/0067071 A1 * 3/2006 Quittner ..... 362/201
2008/0302455 A1 * 12/2008 Huber ..... 150/137
2009/0250366 A1 * 10/2009 Esfahani ..... 206/371

* cited by examiner

*Primary Examiner*—David T Fidei
(74) *Attorney, Agent, or Firm*—Donald R. Schoonover

(57) ABSTRACT

A container accessory for a portable device includes a substantially planar body, a holder mechanism having a sleeve and a cavity for containing small items, second securing means for removably attaching the sleeve to the body, first securing means for removably attaching the body to the portable device or to cooperatively attach the sleeve to the body, an optional clip mechanism for removably attaching the body to the portable device, a closure mechanism to enable selective closure of the cavity, and indicia inscribed along sides of the body. A modified embodiment includes a false bottom and a slider mechanism for expelling short items from the holder mechanism.

14 Claims, 3 Drawing Sheets

Fig. 8
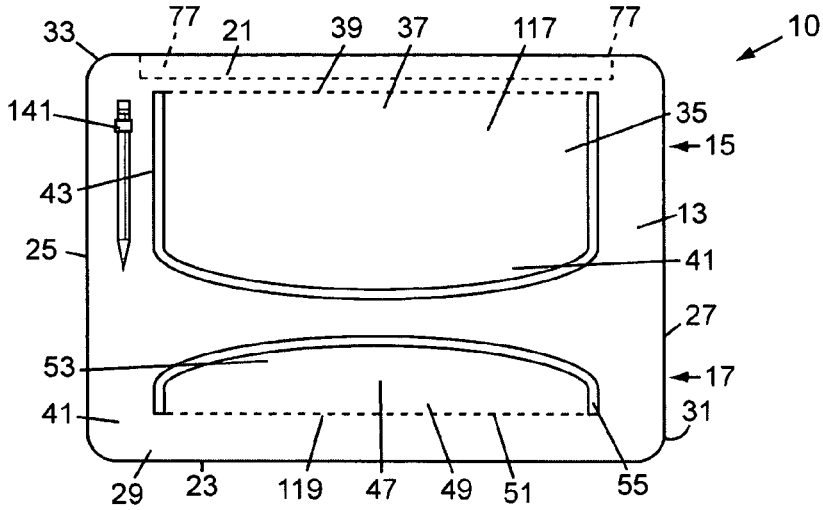
Fig. 9
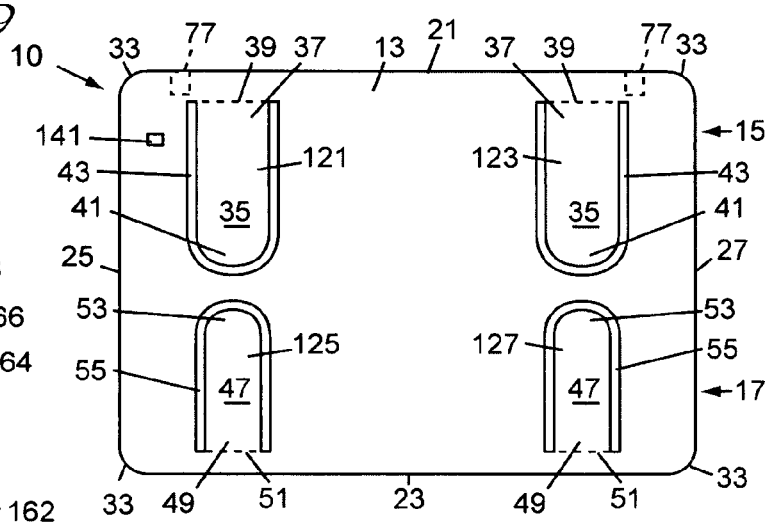
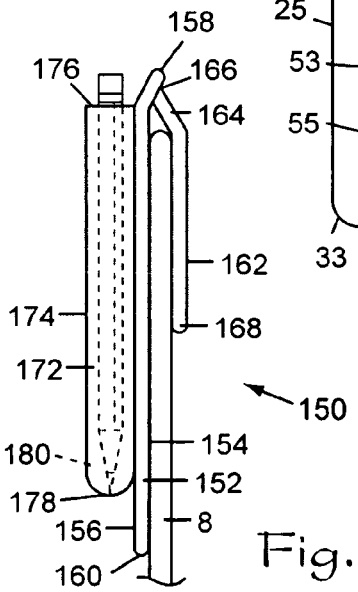
Fig. 11

REMOVABLE CONTAINER ACCESSORY FOR A PORTABLE DEVICE

BACKGROUND OF THE INVENTION

1. Field of the Invention

The present invention is related to containers for small items such as pens, pencils, and other miscellaneous items and, more specifically without limitation, to removable containers for portable devices such as notebooks, backpacks, laptops, etc.

2. Discussion of the Related Art

A common everyday need is convenient access to writing instruments, such as pens, pencils, highlighters and other small items, such as compasses, protractors and straight edges for students. A few of such items can be carried around in a shirt pocket. Many sweaters and many other types and styles of wearing apparel do not have any pockets that can be used to provide convenient access to such small items.

What is needed is an accessory for containing and providing convenient access to various small items, such as pens, pencils, highlighters, etc.

What is also needed is such an accessory that can be removably attached to a portable device, such as a notebook for example.

SUMMARY OF THE INVENTION

The improvements of the present invention for a small item container accessory that is removably attachable to a portable device include a body, securing means, and a holder mechanism.

The body includes an upper edge, a lower edge, opposing sides, a front surface, and a rear surface.

The securing means includes at least one resilient upper tongue having a proximal end defining an upper juncture between the upper tongue and the body, and a distal end extending from the upper juncture towards the lower edge of the body.

The securing means also includes at least one resilient lower tongue having a proximal end defining a lower juncture between the lower tongue and the body, a distal end extending from the lower juncture towards the upper edge of the body.

An optional clip mechanism includes a proximal end, a distal end extending from the proximal end toward the lower edge of the body, and a spacer connecting the proximal end to the rear surface of the body wherein the proximal end is spaced apart from the rear surface of the body and the distal end is biased toward the rear surface of the body.

The container mechanism includes a front wall, a rear wall and a closed bottom end defining a cavity with an open upper end structured to receive various small items therethrough and into the cavity, and a sleeve spaced along and secured to the rear wall wherein the sleeve includes a top end which may be open to slidably receive the distal end of the upper tongue therethrough and into the sleeve, and an open bottom end structured to slidably receive the second tongue therethrough and into the sleeve.

A closure mechanism is provided to enable selective closure of the cavity.

Indicia may be provided along at least one of the opposing sides of the body.

Preferably, the body and the upper and lower tongues are constructed as one-piece from a resilient material.

The upper tongue is structured to enable removable attachment of the body to a feature of a portable device or, cooperatively with the lower tongue, to secure the sleeve to the body when the optional clip mechanism is used to enable removable attachment of the body to a feature of a portable device.

A modified embodiment includes a false bottom and a slider mechanism for expelling short items from the holder mechanism.

PRINCIPAL OBJECTS AND ADVANTAGES OF THE INVENTION

The principal objects and advantages of the present invention include: providing a container accessory for providing convenient access to various small items; providing such a container accessory that can be removably attached to a portable device; and generally providing such a container accessory that is reliable in performance, capable of long lasting life, and particularly well adapted for the proposed usages thereof.

Other objects and advantages of this invention will become apparent from the following description taken in conjunction with the accompanying drawings wherein are set forth, by way of illustration and example, certain embodiments of this invention.

BRIEF DESCRIPTION OF THE DRAWINGS

FIG. 8 is a front view of a body of the container accessory wherein the body is structured to accommodate a pocket having one wide sleeve as shown in FIG. 7.

FIG. 9 is a front view of a body of the container accessory wherein the body is structured to accommodate a pocket having a pair of laterally spaced-apart sleeves as shown in FIG. 6, according to the present invention.

FIG. 11 is a side view of the modified embodiment of the container accessory as shown in FIG. 10, according to the present invention.

DETAILED DESCRIPTION OF THE INVENTION

Figure 1:
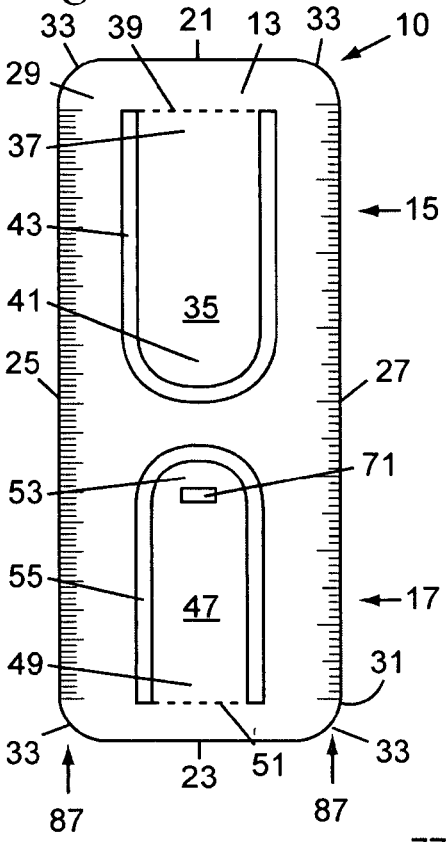
FIG. 1 is a front view of a body of a removable small item container accessory for a portable device, according to the present invention.

As required, embodiments of the present invention are disclosed herein, however, it is to be understood that the disclosed embodiments are merely exemplary of the invention, which may be embodied in various forms. Therefore, specific structural and functional details disclosed herein are not to be interpreted as limiting, but merely as a basis for claims and as a representative basis for teaching one skilled in the art to variously employ the present invention in virtually any appropriately detailed structure.

The present invention is an accessory for conveniently containing various small devices and instruments such as pens, pencils, highlighters, protractors, compasses, erasers, etc., wherein the accessory is removably attachable to a notebook, brief case, backpack, laptop, or other portable device (hereinafter collectively referred to as "portable devices 8" for discussion purposes).

The reference numeral 10 generally refers to an accessory that is removably attachable to a portable device 8 in accordance with the present invention, as hereinafter described and as shown in FIGS. 1 through 9. The accessory 10 includes a body 13, upper securing means 15, lower securing means 17, and holder means 19.

The body 13 includes an upper edge 21, a lower edge 23, opposing sides 25,27, a front surface 29, and a rear surface 31. Preferably, the body 13 is substantially planar with rounded corners 33 as shown in FIGS. 1, 5, 8 and 9.

The upper securing means 15 includes at least one upper tongue 35 having a proximal end 37 defining an upper juncture between the at least one upper tongue 35 and the body 13 (indicated by the dashed line designated by numeral 39 in FIGS. 1, 8 and 9) and a distal end 41 extending from the upper juncture 39 towards the lower edge 23 of the body 13. The at least one upper tongue 35 is resilient and the distal end 41 is spaced apart from the surrounding body 13 by a gap 43 wherein the distal end 41 can be deflected rearwardly from the rear surface 31 at the upper juncture 39 to thereby allow a feature of a portable device 8 to be easily inserted between the at least one upper tongue 35 and the rear surface 31 of the body 13, or deflected forwardly from the front surface 29 of the body 13 to thereby allow insertion of the upper tongue 35 into a sleeve 45 as hereinafter described.

The lower securing means 17 includes at least one lower tongue 47 having a proximal end 49 defining a lower juncture between the at least one lower tongue 47 and the body 13 (indicated by the dashed line designated by numeral 51 in FIGS. 1, 8 and 9) and a distal end 53 extending from the lower juncture 51 towards the upper edge 21 of the body 13. The at least one lower tongue 47 is resilient and the distal end 53 is spaced apart from the surrounding body 13 by a gap 55 wherein the distal end 53 can be deflected forwardly from the front surface 29 at the lower juncture 51 to thereby allow the sleeve 45 to be easily inserted between the at least one lower tongue 47 and the front surface 29 of the body 13 as hereinafter described. Preferably, the body 13, the upper securing means 15, and the lower securing means 17 are constructed as one-piece from resilient material such as a plastic, for example, or other suitable material.

Figure 2:
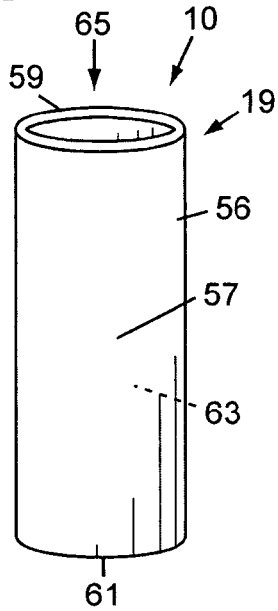
FIG. 2 is a front view of a holder mechanism of the container accessory.
Figure 3:
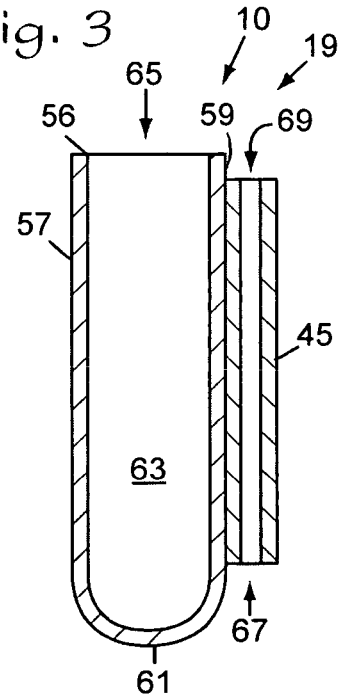
FIG. 3 is a cross-sectional side view of the holder mechanism of the container accessory.

The holder means 19 includes at least one holder mechanism 56 having a front wall 57, a rear wall 59, and a closed bottom end 61 defining a cavity 63 with an open upper end 65 as shown in FIGS. 2 and 3. The upper end 65 is dimensioned and structured to receive various items, such as pen(s), pencil (s) or highlighter(s) for example, therethrough and into the cavity 63. The at least one holder mechanism 56 further includes at least one sleeve 45 spaced along, and secured to, the rear wall 59 wherein the at least one sleeve 45 includes an open bottom end 67 structured to slidably receive the distal end 53 of the at least one lower tongue 47 therethrough and into the at least one sleeve 45. The at least one sleeve 45 also includes an upper end 69 (which may be open for some applications as shown in FIG. 3) to thereby slidably receive the distal end 41 of the at least one upper tongue 35 therethrough and into the sleeve 45 as described herein. For some applications, the at least one holder mechanism 56 may be constructed, at least partially, of flexible material.

For some applications, the extent to which the distal end 41 of the at least one upper tongue 35 extends from the upper juncture 39 toward the lower edge 23 is greater than the extent to which the distal end 53 of the respective at least one lower tongue 47 extends from the lower juncture 51 toward the upper edge 21. Then, for applications wherein both of the upper and lower tongues 35, 47 are to be inserted into a sleeve 45 as described herein, the at least one holder mechanism 56 can be installed by deflecting and slidably inserting the at least one upper tongue 35 into a respective sleeve 45 through the top end 69 until the bottom end 67 of the sleeve 45 clears the distal end 53 of the respective lower tongue 47 whereupon the lower tongue 47 can be deflected and slidably inserted into the sleeve 45 through the bottom end 67 of the sleeve 45. The sleeve 45 is then slidably displaced downwardly along the gap 55 until the bottom end 67 of the sleeve 45 abuts against the body 13 adjacent to the lower juncture 51, thereby removably securing the holder mechanism 19 in place relative to the body 13 and preventing the sleeve 45 from inadvertently sliding off the distal end 41 of the upper tongue 35.

For some applications, insertion of the at least one upper tongue 35 into the respective sleeve 45 may not be required if the sleeve 45 is stably mountable on the respective lower tongue 47.

For some applications, the lower securing means 17 may include a grip-enhancing means 71 structured to enhance securement of the sleeve 45 between the lower tongue 47 and the front surface 29 of the body 13. For example, the grip-enhancing means 71 may comprise a protrusion located on the distal end 53 of the lower tongue 47, as indicated in FIG. 1, a depression in the distal end 53 of the lower tongue 47 that mates with a depression in the sleeve 45 when the sleeve 45 has been mounted on the lower tongue 47 as described herein, or other suitable grip-enhancing means as desired.

Figure 4:
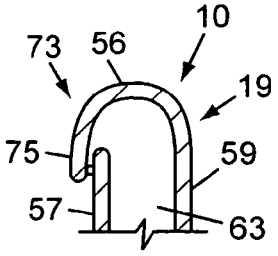
FIG. 4 is a fragmentary, side cross-sectional view of a closure mechanism of the holder mechanism of the container accessory.

For some applications, it may be desirable to include a closure mechanism 73, such as a flexible flap 75 for example as shown in FIG. 4, wherein the flap 75 is structured to enable selective closure of the open upper end 65 of the holder mechanism 56 to thereby confine items contained in the cavity 63.

Figure 5:
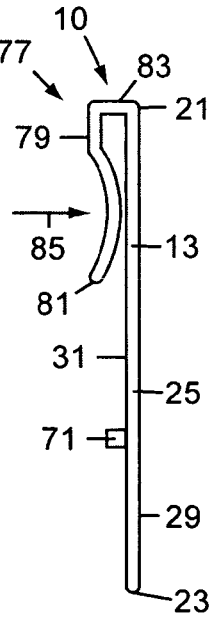
FIG. 5 is a side view of an optional clip mechanism of the container accessory.

For some applications, the accessory 10 may include an optional clip mechanism 77 spaced adjacent to, and secured to, the rear surface 31 of the body 13, as indicated in FIGS. 5, 8 and 9. The clip mechanism 77 includes a proximal end 79 connected to the rear surface 31 of the body 13 and a distal end 81 extending from the proximal end 79 towards the lower edge 23 of the body 13.

For applications wherein the accessory 10 may be secured to a thick feature of a portable device 8, the clip mechanism 77 may include a spacer 83 connecting the proximal end 79 of the clip mechanism 77 to the rear surface 31 of the body 13 wherein the distal end 81 of the clip mechanism 77 is biased toward the rear surface 31 of the body 13, as indicated by the arrow designated by numeral 85 in FIG. 5. It is foreseen that in most cases, the spacer 83 will connect the proximal end 79 of the clip mechanism 77 to the upper edge 21 of the body 13. For such applications, the at least one upper tongue 35 may optionally be used to secure, cooperatively with the respective lower tongue 47, the holder mechanism 56 to the body 13 by inserting the upper tongue 35 through an open upper end 65 of and into the sleeve 45 as described herein.

If desired, the accessory 10 may include indicia 87 inscribed along one or both of the opposing sides 25, 27 of the body 13, such as inches along one side 25 or 27 and centimeters along the other side 27 or 25 for example, as indicated in FIG. 1.

Figure 6:
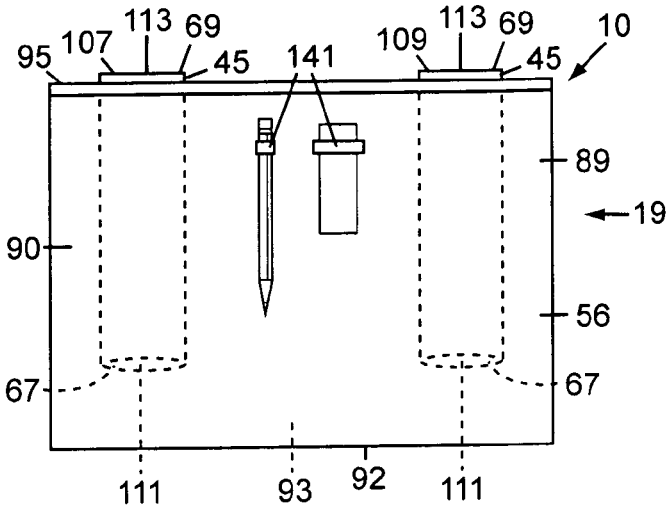
FIG. 6 is a front view of a pocket of the holder mechanism of the container accessory wherein the pocket includes a pair of laterally spaced-apart sleeves.
Figure 7:
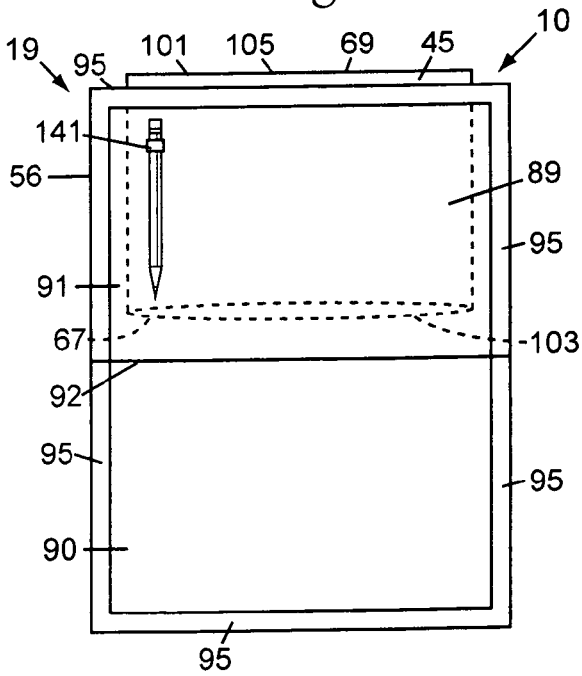
FIG. 7 is a front view of a pocket of the container accessory wherein the pocket includes one wide sleeve and the pocket is shown in an opened configuration.

If it is desired that the present invention accommodate larger items or a greater quantity of items, the holder mechanism 56 may include one or more pockets 89, each with a front wall 90, a rear wall 91 and a closed bottom end 92 defining a cavity 93, and a closure mechanism 95 structured to enable selective closure of the cavity 93, as shown in FIGS. 6 and 7. The closure mechanism 95 may comprise one or more zipper(s), hook and loop fastener(s), slide fastener(s), or other suitable fastener(s). For some applications, it may be desirable to locate the closure mechanism 95 above the cavity 93, as shown in FIG. 6. For other applications, it may be desirable to locate the closure mechanism 95 both above and alongside the cavity 93, as shown in FIGS. 4 and 7, to thereby provide greater access to items contained in the holder mechanism 56.

Each pocket 89 includes the at least one sleeve 45 being a single, wide sleeve 101 having an open lower end 103 and an upper end 105, as shown in FIG. 7. Alternatively, the at least one sleeve 45 may comprise a pair of narrow sleeves 107, 109 laterally spaced-apart from each other and having open lower ends 111 and upper ends 113, as shown in FIG. 6.

Means for securing the pocket 89 (shown in FIG. 7) to a portable device 8 includes the at least one upper tongue 35 being a wide upper tongue 117 and the at least one lower tongue 47 being a wide lower tongue 119, as shown in FIG. 8, to accommodate the single wide sleeve 101 shown in FIG. 7, or the at least one upper tongue 35 may comprise a pair of laterally spaced-apart upper tongues 121, 123 and the at least one lower tongue 47 may comprise a pair of laterally spaced-apart lower tongues 125, 127, as shown in FIG. 9, to accommodate the pair of laterally spaced-apart sleeves 107, 109 of the pocket 89 shown in FIG. 6 as hereinbefore described.

One or more of the clip mechanisms 77 connected to the rear surface 31 of the body 13 are structured to removably attach the body 13 to a feature of a portable device 8 as hereinbefore described.

Also, an elastic band 141 structured to releasably encircle a pen, pencil, highlighter or other similar device, may be secured to the body 13 as shown in FIGS. 8 and 9, or to or inside of the pocket 89 as shown in FIGS. 6 and 7.

Figure 10:
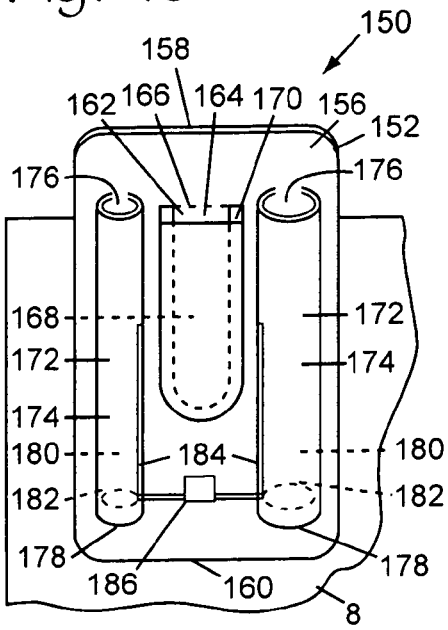
FIG. 10 is a front view of a modified embodiment of a removable small item container accessory according to the present invention, showing the container accessory in use with a portable device.

The reference numeral 150 generally refers to a modified embodiment of a container accessory that is removably attachable to a portable device 8 in accordance with the present invention, as shown in FIGS. 10 and 11. Many of the features of the modified embodiment 150 are substantially similar to those hereinbefore described and will not be reiterated here in detail.

The modified embodiment 150 includes a substantially planar body 152 having a rear surface 154, a front surface 156 with an upper edge 158 and a lower edge 160, a tongue 162 having a proximal end 164 defining a juncture 166 between the tongue 162 and the body 152, and a distal end 168 extending from the juncture 166 towards the lower edge 160. The tongue 162 is resilient and the distal end 168 is spaced apart from the surrounding body 152 by a gap 170 wherein the distal end 168 can be deflected rearwardly from the rear surface 154 at the juncture 166 to thereby allow a feature of a portable device 8 to be easily inserted between the tongue 162 and the rear surface 154 of the body 152, as shown in FIG. 11.

The modified embodiment 150 further includes at least one tubular-shaped holder mechanism 172 having a wall 174 with an open upper end 176 and a closed lower end 178 defining a cavity 180 structured to receive a pen, pencil, highlighter or other similar item therein. Preferably, the at least one holder mechanism 172 is molded integrally with the body 152.

For some applications of the modified embodiment 150, it may be desirable to include a false bottom 182 in the cavity 180 and a slot 184 through the wall 174 of the at least one holder mechanism 172. A slider mechanism 186 is secured to the false bottom 182 and extends transversely outwardly through the slot 184, as shown in FIG. 10. The slot 184 is structured to enable displacement of the slider mechanism 186 and the false bottom 182 toward the upper edge 158 of the body 152 to thereby expel a short item such as a pencil or other short object from the cavity 180.

In an application of the present invention wherein only a lower tongue is used to secure the holder mechanism to the body, the lower tongue is deflected forwardly and inserted upwardly through the lower end of and into the sleeve of the holder mechanism until the sleeve abuts the body adjacent to the lower juncture between the lower tongue and the body. The upper tongue is deflected rearwardly and a feature of a portable device, such as a notebook cover, is inserted between the upper tongue and the rear surface of the body to secure the body to the notebook cover. An item or items placed in the holder mechanism is then readily available to a user when needed.

In an application of the present invention wherein both the upper and lower tongues are used to secure the holder mechanism to the body, the upper tongue is deflected forwardly and inserted through the upper end of and into the sleeve of the holder mechanism until the lower end of the sleeve clears the distal end of the lower tongue. The lower tongue is then deflected forwardly and inserted upwardly into the sleeve until the sleeve abuts the body adjacent to the lower juncture between the lower tongue and the body. A feature of a portable device such as a notebook cover is inserted between the clip mechanism and the rear surface of the body to secure the body to the notebook cover. An item or items placed in the holder mechanism is then readily available to a user when needed.

It is to be understood that while certain forms of the present invention have been illustrated and described herein, it is not to be limited to the specific forms or arrangement of parts as described and shown.

What is claimed and desired to be covered by Letters Patent is as follows:

1. A container accessory for a portable device, the accessory comprising:

(a) a substantially planar body including an upper edge, a lower edge, opposing sides, a front surface, and a rear surface;

(b) upper securing means including at least one resilient upper tongue having a proximal end defining an upper juncture with the body, a distal end extending from the upper juncture towards the lower edge of the body, and a gap between the upper tongue and the body surrounding the upper tongue;

(c) lower securing means including at least one resilient lower tongue having a proximal end defining a lower juncture with the body, a distal end extending from the lower juncture towards the upper edge of the body, grip-enhancing means located at least partially on the distal end of the lower tongue, and a gap between the lower tongue and the body surrounding the lower tongue;

(d) a clip mechanism having a proximal end, a distal end extending from the proximal end toward the lower edge of the body, and a spacer connecting the proximal end to the top edge of the body wherein the proximal end is spaced apart from the rear surface of the body and the distal end is biased toward the rear surface of the body; and (e) a flexible holder mechanism having a front wall, a rear wall and a closed bottom end defining a cavity with an open upper end structured to receive various small items therethrough and into the cavity, and a sleeve secured to the rear wall wherein the sleeve includes an open bottom end structured to slidably receive the lower tongue therethrough and into the sleeve and an open upper end structured to slidably receive the upper tongue therethrough and into the sleeve;

(f) a closure mechanism structured to enable selective closure of the cavity; and (g) indicia along at least one of the opposing sides of the body; and (h) wherein the body, the upper securing means, and the lower securing means are constructed or formed as one-piece from a resilient material, (i) wherein the extent to which the distal end of the upper tongue extends from the upper juncture towards the lower edge is greater than the extent to which the distal end of the lower tongue extends from the lower juncture towards the upper edge of the body, and (j) wherein the first securing means is structured to enable removable attachment of the body to a portable device, and the second securing means is structured to enable removable attachment of the holder mechanism to the body.

2. A container accessory for a portable device, the container accessory comprising:

(a) a body including an upper edge, a lower edge, opposing sides, a front surface, and a rear surface;

(b) upper securing means including at least one resilient upper tongue having a proximal end defining an upper juncture with the body, and a distal end extending from the upper juncture towards the lower edge of the body;

(c) lower securing means including at least one resilient lower tongue having a proximal end defining a lower juncture with the body, and a distal end extending from the lower juncture towards the upper edge of the body; and (d) at least one flexible holder mechanism having an open upper end wherein the at least one holder mechanism is structured to receive at least one pencil, pen, or small item therein; and (e) wherein the upper and lower securing means are substantially coplanar with the body, the upper securing means being structured to deflect rearwardly relative to the rear surface of the body to thereby detachably secure the body to a feature of a portable device between the body and the at least one resilient upper tongue, and the lower securing means being structured to deflect forwardly relative to the front surface of the body to thereby detachably secure the at least one holder mechanism between the body and the at least one resilient lower tongue, and wherein the at least one holder mechanism has a front wall, a rear wall, an open upper end, and a closed bottom end defining a cavity in the at least one holder mechanism, and includes at least one sleeve spaced along and connected to the rear wall wherein the at least one sleeve includes an open bottom end structured to slidably receive the at least one lower tongue therethrough and into the at least one sleeve.

3. A container accessory for a portable device, the container accessory comprising:

(a) a body including an upper edge, a lower edge, opposing sides, a front surface, and a rear surface;

(b) upper securing means including at least one resilient upper tongue having a proximal end defining an upper juncture with the body, and a distal end extending from the upper juncture towards the lower edge of the body;

(c) lower securing means including at least one resilient lower tongue having a proximal end defining a lower juncture with the body, and a distal end extending from the lower juncture towards the upper edge of the body;

(d) at least one flexible holder mechanism having an open upper end wherein the at least one holder mechanism is structured to receive at least one pencil, pen, or small item therein; and (e) at least one clip mechanism having a proximal end connected to the rear surface of the body and a distal end extending from the proximal end towards the lower edge of the body; and (f) wherein the upper and lower securing means are substantially coplanar with the body, the upper securing means being structured to deflect rearwardly relative to the rear surface of the body to thereby detachably secure the body to a feature of a portable device between the body and the at least one resilient upper tongue, and the lower securing means being structured to deflect forwardly relative to the front surface of the body to thereby detachably secure the at least one holder mechanism between the body and the at least one resilient lower tongue.

4. A container accessory for a portable device, the container accessory comprising:

(a) a body including an upper edge, a lower edge, opposing sides, a front surface, and a rear surface;

(b) upper securing means including at least one resilient upper tongue having a proximal end defining an upper juncture with the body, and a distal end extending from the upper juncture towards the lower edge of the body;

(c) lower securing means including at least one resilient lower tongue having a proximal end defining a lower juncture with the body, and a distal end extending from the lower juncture towards the upper edge of the body;

(d) at least one flexible holder mechanism having an open upper end wherein the at least one holder mechanism is structured to receive at least one pencil, pen, or small item therein; and (e) an elastic band secured to the body or the at least one holder mechanism and structured to releasably encircle and retain a pen, pencil, highlighter, or other similar device; and (f) wherein the upper and lower securing means are substantially coplanar with the body, the upper securing means being structured to deflect rearwardly relative to the rear surface of the body to thereby detachably secure the body to a feature of a portable device between the body and the at least one resilient upper tongue, and the lower securing means being structured to deflect forwardly relative to the front surface of the body to thereby detachably secure the at least one holder mechanism between the body and the at least one resilient lower tongue.

5. A container accessory for a portable device, the container accessory comprising:

(a) a body including an upper edge, a lower edge, opposing sides, a front surface, and a rear surface;

(b) upper securing means including at least one resilient upper tongue having a proximal end defining an upper juncture with the body, and a distal end extending from the upper juncture towards the lower edge of the body;

(c) lower securing means including at least one resilient lower tongue having a proximal end defusing a lower juncture with the body, and a distal end extending from the lower juncture towards the upper edge of the body; and (d) at least one flexible holder mechanism having an open upper end wherein the at least one holder mechanism is structured to receive at least one pencil, pen, or small item therein, the at least one holder mechanism including at least one pocket having a top, sides, a cavity and a closure mechanism structured to enable selective closure of the cavity; and (e) wherein the upper and lower securing means are substantially coplanar with the body, the upper securing means being structured to deflect rearwardly relative to the rear surface of the body to thereby detachably secure the body to a feature of a portable device between the body and the at least one resilient upper tongue, and the lower securing means being structured to deflect forwardly relative to the front surface of the body to thereby detachably secure the at least one holder mechanism between the body and the at least one resilient lower tongue.

6. A container accessory for a portable device, the container accessory comprising:

(a) a body including an upper edge, a lower edge, a front surface, and a rear surface;

(b) a resilient tongue substantially coplanar with the body and having a proximal end defining a juncture between the tongue and the body, and a distal end extending from the juncture towards the lower edge of the body; and (c) at least one tubular-shaped holder mechanism connected to the front surface of the body, the at least one tubular-shaped holder mechanism having a wall with an open upper end and a closed lower end defining a cavity structured to receive at least one pencil, pen, highlighter or other similar item therein, each at least one tubular-shaped holder mechanism including:

(1) a false bottom;

(2) a slot through the wall; and (3) a slider mechanism secured to the false bottom and extending transversely outwardly through the slot; and (4) wherein the slot is structured to enable displacement of the slider mechanism and the false bottom toward the upper edge of the body to thereby expel short items from the cavity; and (d) wherein the tongue is structured to be deflectable rearwardly relative to the rear surface of the body to thereby detachably secure a feature of a portable device between the body and the resilient tongue.

7. A container accessory as described in claim 2, wherein the at least one holder mechanism is constructed of at least partially of flexible material.

8. An accessory as described in claim 2, wherein the at least one sleeve further includes the top end thereof being open and structured to slidably receive the at least one upper tongue therethrough and into the at least one sleeve.

9. A container accessory as described in claim 2, wherein the lower securing means includes grip-enhancing means located at least partially on the distal end of the at least one lower tongue.

10. A container accessory as described in claim 2, further comprising a closure mechanism structured to enable selective closure of the open upper end of the at least one holder mechanism.

11. A container accessory as described in claim 3, wherein the proximal end of the at least one clip mechanism is spaced apart from and connected to the rear surface of the body by a spacer wherein the distal end of the at least one clip mechanism is biased toward the rear surface of the body.

12. A container accessory as described in claim 5, wherein the at least one pocket includes at least one elastic band structured to releasably encircle and retain a pen, pencil, highlighter, or other similar device.

13. A container accessory as described in claim 12, wherein the closure mechanism is located above the cavity.

14. A container accessory as described in claim 5, wherein the closure mechanism is selected from the set consisting of a zipper(s), hook and loop fastener(s), slide fastener(s), and magnetic device(s), wherein the closure mechanism is positioned at least along the sides of the at least one pocket to thereby provide greater access to items contained in the at least one pocket.

* * * * *